US008976505B2

(12) United States Patent
Kernwein et al.

(10) Patent No.: US 8,976,505 B2
(45) Date of Patent: Mar. 10, 2015

(54) METHOD FOR CONTROLLING A GLOW PLUG IN A DIESEL ENGINE

(75) Inventors: Markus Kernwein, Bretten Büchig (DE); Olaf Toedter, Walzbachtal (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 1274 days.

(21) Appl. No.: 12/227,736

(22) PCT Filed: May 31, 2007

(86) PCT No.: PCT/EP2007/004813

§ 371 (c)(1),
(2), (4) Date: Mar. 25, 2009

(87) PCT Pub. No.: WO2007/140922

PCT Pub. Date: Dec. 13, 2007

(65) Prior Publication Data

US 2009/0316328 A1 Dec. 24, 2009

(30) Foreign Application Priority Data

Jun. 2, 2006 (DE) ..... 10 2006 025 834

(51) Int. Cl.
*F23Q 7/24* (2006.01)
*F02P 19/02* (2006.01)

(52) U.S. Cl.
CPC ..... *F02P 19/025* (2013.01); *F02P 19/023* (2013.01)
USPC ..... 361/264

(58) Field of Classification Search
USPC ..... 361/264
See application file for complete search history.

(56) References Cited

U.S. PATENT DOCUMENTS

| | | | | |
|---|---|---|---|---|
| 4,858,576 | A * | 8/1989 | Jeffries et al. | 123/145 A |
| 6,186,107 | B1 * | 2/2001 | Navalon Carretero | 123/145 A |
| 2005/0039732 | A1 * | 2/2005 | Toedter et al. | 123/605 |
| 2006/0207541 | A1 * | 9/2006 | Hiramatsu | 123/145 A |

FOREIGN PATENT DOCUMENTS

| | | | |
|---|---|---|---|
| EP | 370964 | A1 * | 5/1990 |
| JP | 57203872 | A * | 12/1982 |
| JP | 59108877 | A * | 6/1984 |
| JP | 61025971 | A * | 2/1986 |

OTHER PUBLICATIONS

Special Reprint from Motortechnischen Zeitschrift (MTZ), "Instant Start System (ISS) The Electronically Controlled Glow System for Diesel Engines", MTZ Motortechnische Zeitschrift 61 (2000) 10.

* cited by examiner

*Primary Examiner* — Thienvu Tran
*Assistant Examiner* — Ann Hoang
(74) *Attorney, Agent, or Firm* — Hackler Daghighian & Martino

(57) ABSTRACT

A method for controlling a glow plug in a diesel engine, in particular in the preheating phase, is described. According to the invention, it is provided that the time gradient of an electrical variable which varies according to the temperature of the glow plug is measured and compared with a threshold value, and when said time gradient exceeds or drops below the threshold value, the electric supply voltage of the glow plug is changed.

19 Claims, 2 Drawing Sheets

METHOD FOR CONTROLLING A GLOW PLUG IN A DIESEL ENGINE

The present invention relates to a method for controlling a glow plug in a diesel engine.

FIG. 1 shows the block diagram of a glow plug control device 1 used for carrying out a method known from an article entitled "The electronically controlled ISS preheat system for diesel engines", published in DE-Z MTZ Motortechnische Zeitschrift 61, (2000) 10, pp. 668-675. That control device comprises a microprocessor 2 with integrated digital-to-analog converter, a number of MOSFET power semiconductors 3 for switching on and off an identical number of glow plugs 4, an electric interface 5 for establishing connection with an engine control unit 6, and an internal voltage supply 7 for the microprocessor 2 and for the interface 5. The internal voltage supply 7 is connected with a vehicle battery via "terminal 15" of a vehicle.

The microprocessor 2 controls the power semiconductors 3, reads their status information and communicates with the engine control unit 6 via the electric interface 5. The signals required for communication between the engine control unit 6 and the microprocessor 2 are conditioned by the interface 5. The voltage supply 7 supplies a steady voltage for the microprocessor 2 and the interface 5.

When the diesel engine is started in cold condition, then the control unit 1 supplies the heater plugs 1 with a heating-up voltage of 11 Volts, for example, in time average so that the glow plugs will as quickly as possible exceed the ignition temperature—approximately 860° C.—and reach the steady-state temperature, which the glow plug is to assume and to maintain after ignition of the engine until the engine has reached its normal operating temperature.

The steady-state temperature typically is in the range of approximately 1000° C. The voltage required for maintaining the steady-state temperature is lower than that required for heating up the glow plug. For modern glow plugs, it typically is as low as 5 Volts to 6 Volts in time average.

The power semiconductors 3 are controlled by the microprocessor 2 by a pulse-width modulation method with the result that the voltage provided by the on-board system, which is supplied to the power semiconductor 3 via "terminal 30" of the vehicle, is modulated so that the desired voltage will be applied to the heater plugs in time average.

The ignition temperature and the steady-state temperature should be reached as quickly as possible. In modern glow plugs, a temperature of 1000° C. is reached already after approximately 2 s, starting out from a cold engine (for example 0° C.). Such a rapid rise in temperature cannot end abruptly. Frequently, the temperature will overshoot, i.e. it will rise beyond the steady-state temperature, in spite of the fact that the effective voltage has been lowered from 11 Volts, for example, to 6 Volts, reaching a maximum of typically some ten degrees up to approximately 200° C. above the desired steady-state temperature, and dropping to the desired steady-state temperature only thereafter.

The time required for heating up the glow plug from the cold starting condition to the point where the steady-state temperature is exceeded is also known as preheating time or preheating phase. In order to ensure that this temperature will be reached but will not be exceeded to an extent that the glow plug may be damaged or its service life may be impaired, it has been known to supply the glow plug, during the preheating phase, with a predefined energy in the form of electric energy. For a given type of glow plug the energy, and the period of time over which it is supplied, are factors that influence the rapidity of temperature rise in the tip of the glow plug and, together with the starting temperature of the glow plug, also the degree of temperature overshoot of the glow plug.

While rapid rising of the glow plug temperature is desirable to permit the diesel engine to be started without delay, if possible, it sets the glow plug at a risk of being overloaded and damaged, or of its service life being impaired. One particular risk is seen in the development of an excessively high temperature, especially due to excessive temperature overshoot in the temperature curve. Another particular risk results from the unavoidable thermal inertia of the glow plug and from the fact that glow plugs are composed from materials of different thermal inertia, namely from materials of different thermal capacity and different thermal conductivity. Consequently, temperature differences will be encountered in glow plugs, especially in interface areas between different materials, which differences will rise as the temperature differences increase, while the temperature differences will become the higher the more quickly the temperature changes. The mechanical stresses encountered in every preheating phase may cause damage to the glow plug and/or may reduce its service life.

Consequently, there is a desire to make the temperature of the glow plug controllable. Up to now, this has been possible at best during the so-called afterglow phase when the glow plug is to reach and to maintain its steady-state temperature after the engine has been started. Contrary to the preheating phase there is, however, no risk of overloading of the glow plug in the afterglow phase. In order to permit the temperature of the glow plug to be controlled in the preheating phase, one would first of all have to measure the temperature. This practically can be achieved only by measurements, via the temperature-dependent electric resistance of the glow plug. However, the resistance of the glow plug is subject to substantial production-related statistical scatter which limits the quality of information of a resistance measurement with respect to the temperature of the glow plug. In addition, the temperature measurement and the control of the temperature on the basis of that measurement are rendered even more difficult by the short duration of the heating-up phase and the steepness of the temperature rise. The scatter of the resistance values and the dynamics of the temperature rise together provide the worst imaginable preconditions for controlling the temperature in the preheating phase.

In view of these difficulties, DE 102 47 042 B3 proposes to reproduce the thermal behavior of the glow plug in its preheating phase by means of a physical model, for example using a capacitor designed so that is will store electric energy supplied to it with similar dynamics as the glow plug by which the electric energy supplied to it during the preheating phase is converted to heat and stored. According to the teachings of DE 102 47 042 B3, the physical model of the glow plug is implemented in the control device for the glow plug and is supplied with a small current in parallel to the heating power of the glow plug. If a capacitor is used, then its design is such that its charge is proportional to the temperature of the glow plug. Instead of monitoring the temperature of the glow plug, the control device monitors the charge of the capacitor and controls the glow plug based on its charging state, starting out from the assumption that its charge corresponds to the temperature of the glow plug. It is a disadvantage of that arrangement that the result cannot possibly be better than the physical model. However, the temperature curve of the glow plug depends of quite a number of factors: Variations of the supply voltage, statistical variation of the glow plug resistance, the conditions of installation of the glow plug in the engine, the engine temperature, the operating state of the engine, especially the engine speed, the injection rate, the engine load and, finally, the state of ageing of the glow plug.

Especially the cooling-down conditions prevailing in the engine can be reflected by such a physical model either not at all or only with difficulty. DE 103 48 391 B3 therefore suggests to simulate the cooling-down conditions in a mathematical model. Such a mathematical model is intended to provide information on the temperature development of a glow plug when the engine had been shut down and is to be restarted. In that case, the glow plug is still warm, and the energy applied to it may not be as high as in the case of a cold start because otherwise the glow plug would get excessively hot and might be damaged.

SUMMARY OF THE INVENTION

Now, it is the object of the present invention to show how glow plugs in a diesel engine can be heated up quickly without any risk of being damaged by being heated up too rapidly or to an excessively high temperature. That object is achieved by a method having the features defined in claim 1. Advantageous further developments of the invention are the subject-matter of the sub-claims.

According to the invention, a glow plug is controlled in a diesel engine, especially during the preheating phase, by measuring the time derivative of a time-dependent electric variable of the glow plug, comparing it with a threshold value and varying the effective supply voltage of the glow plug when the threshold value is passed.

That way of proceeding provides substantial advantages:

The invention avoids the difficulties encountered by experts in attempting to control the temperature of a glow plug directly or with the aid of a physical or mathematical model of the glow plug; it does so by not attempting to determine the temperature of the glow plug or any variable of a physical model modeled to the temperature of the glow plug. Instead, the invention determines the time gradient of a temperature-dependent electric variable, present at the glow plug, and compares it with one or more threshold values.

The gradient of a temperature-dependent measured electric variable can be determined without there being any need to know the absolute temperature value. This simplifies the measuring task quite considerably.

The method according to the invention is largely independent of production-related scatter of the resistance of the glow plugs.

The steepness of the temperature rise of the tip of the glow plug, which may become a risk for the glow plug if too steep and which prevents rapid starting of the diesel engine if too flat, is automatically reflected by the gradient of the temperature-dependent electric variable measured on the glow plug. Consequently, the gradient is directly representative of the heating-up speed of the glow plug and of the degree the glow plug is loaded by the heating-up process.

When the gradient reaches or exceeds a predefined load limit, the load can be reduced immediately by reducing the effective electric voltage supplied to the glow plug.

In contrast, when the gradient indicates that the temperature rise reflected by it could be steeper without any risk of damage to the glow plug, then the effective electric voltage supplied to the glow plug can be increased even in the current preheating phase so that the ignition temperature and, in consequence thereof, the steady-state temperature of the glow plug can be reached more quickly without any damage to the glow plug, because monitoring of the gradient relative to an upper threshold value prevents excessive loading of the glow plug.

The method according to the invention is suited for optimizing the heating-up process of the glow plugs by ensuring that the glow plugs are operated near a predefined load limit.

Relying on the development of the gradient of a temperature-dependent electric variable it is possible to estimate the final temperature that would be reached in case the development of the heating-up process remained without any controlling intervention. Such information can be obtained, for example, by comparing the development in time of the gradient with a reference characteristic representative of the development in time of the gradient that was recorded for a glow plug of the same type under realistic installation conditions. Especially, it is possible to compare the curve of the gradient with the curve of the gradient of a different glow plug, heated up under ideal conditions, and to reduce the effective supply voltage when the observed gradient suggests that an excessive final temperature will be reached, or in contrast to increase the supply voltage temporarily when the observed gradient suggests that the final temperature to be expected will be too low.

In extreme cases, determining the gradient may even cause the heating-up process of the glow plug to be ended completely, instead of being decelerated or delayed, in order to prevent greater damage. In that case, the driver may be warned that something is wrong with one of the glow plugs, and he may even be informed as to which one of the glow plugs is concerned.

BRIEF DESCRIPTION OF THE DRAWINGS

The advantages and features of the present invention will be better understood by the following description when considered in conjunction with the accompanying drawings in which.

DETAILED DESCRIPTION

Figure 1:
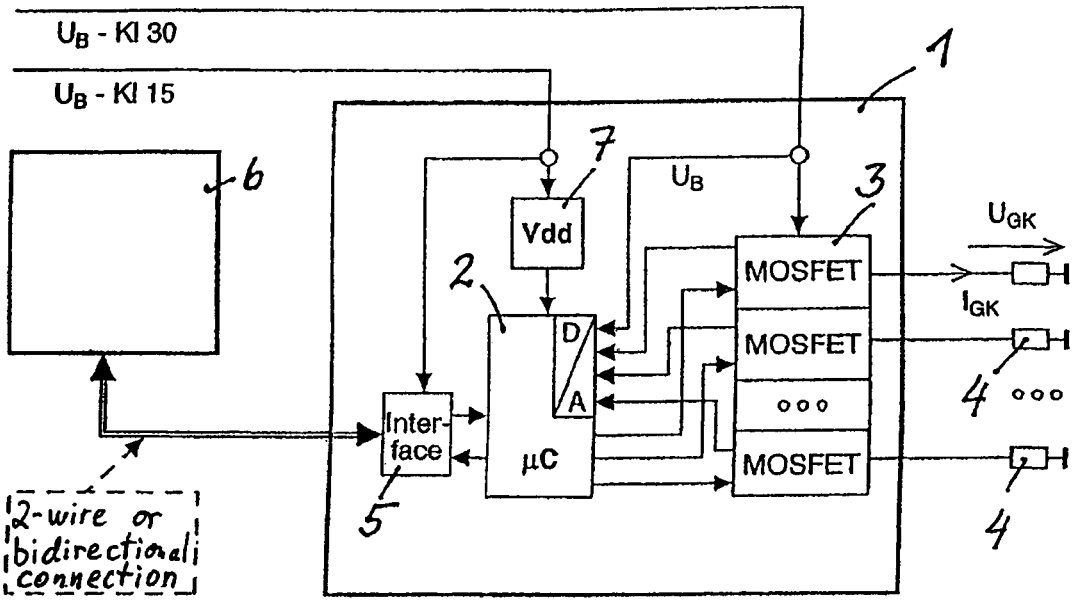
Fig. 1 (Prior Art)
FIG. 1 shows the block diagram of a glow plug control device.

According to the invention, useful information on the development of the heating process of a glow plug is derived from the time gradient of a temperature-dependent measured electric variable. In order to determine the electric variable that depends on the temperature one may observe the electric resistance of a glow plug and determine its gradient. The resistance can be determined by measuring the voltage available in the on-board system, combined with an independent power measurement. Preferably, one takes into account in this case the voltage drop occurring in the supply line to the glow plug in order to obtain a measuring result which, instead of relying on the resistance of the supply line, substantially only depends on the resistance of the heating conductor or conductors present in the glow plug. The way how to take into account the resistance of the supply line has been disclosed by DE 10 2006 010 082 A1, to which reference is therefore expressly made.

Modern steel glow plugs with short heating-up times comprise a heater coil and a sensor coil combination concentrated in the tip of the glow plug, the resistance of the heater coil having a smaller temperature coefficient than the resistance of the controlling coil, which may have a PTC characteristic, for example. The gradient of the electric resistance is the highest in the cold condition of the glow plug. It drops as the temperature rises and passes the value zero when the temperature of the glow plug reaches its maximum, then gets negative when the temperature of the glow plug drops again, and approaches the value zero as the temperature of the glow plug approaches its steady-state temperature. Limiting the maximum of the gradient of the resistance is the easiest way to limit the steepness of the temperature rise. This is most simply achieved by reducing the effective supply voltage of the glow plug when the gradient exceeds a predefined threshold value. Conversely, if the observed gradient lies below a threshold value, the effective supply voltage for the glow plug may be correspondingly increased to speed up the heating process.

Another way of carrying out the method according to the invention consists in observing the power consumption of the glow plug, this value being likewise temperature-dependent, given the temperature dependence of the electric resistance of the glow plug. The power consumption is the highest in the cold condition of the glow plug, then drops until the glow plug passes its temperature maximum, and then rises again slightly until the glow plug approaches its steady-state temperature. Consequently, the gradient of the electric current is negative at the beginning, rises during the preheating phase of the glow plug, then passes the value zero when the resistance of the glow plug reaches its maximum, and finally approaches the value zero, coming from positive values, as the temperature of the glow plug approaches its constant steady-state temperature. In order to be independent of the sign of the gradient, the absolute value of the gradient may be used for comparison with the threshold values. The threshold values can be derived from empirical values.

Just as the curve of the gradient of the electric power, the curve of the gradient of the electric resistance can be compared with a reference curve. When the observed development in time of the gradient is steeper than the reference curve, then this development can be counteracted by reducing the effective supply voltage of the glow plug, whereas in cases where the observed curve of the gradient of the power is flatter than the reference curve the effective supply voltage to the glow plug can be temporarily increased in order to accelerate the heating-up process of the glow plug.

In order to provide some rough protection for the glow plugs, a single threshold value may be determined for the gradient of the electric resistance and/or the gradient of the electric power consumption so as to limit the steepness of the temperature rise absolutely toward the top. That limitation is effective in the lower temperature range of the preheating phase.

The temperature level that can be reached may be controlled, irrespective of any controlling manipulation of the effective supply voltage intended to avoid that certain threshold values will be exceeded, by supplying the glow plug with a predefined energy in the preheating phase. That energy mainly determines the temperature that can be reached, the period of time over which the energy is supplied getting somewhat longer in case an initially excessive temperature rise should be decelerated by the method according to the invention, whereas the preheating phase gets shorter in case the effective supply voltage should be increased in consequence of the gradient dropping below its lower limit.

Preferably, instead of using a single threshold value for the preheating phase, one varies the threshold value over the duration of the preheating phase so that the steepness of the temperature rise can be controlled not only at the beginning of the preheating phase but during the entire preheating phase. This allows the preheating time to be kept as short as possible and/or the value of temperature overshoot of the glow plug to be reduced so that the heating-up curve of the glow plug is restricted to between suitable threshold values of the gradient and is thereby shaped and approximated to an ideal curve.

In the simplest case, the threshold values are adapted in steps, i.e. are reduced in steps as the preheating phase proceeds. The greater the number of steps in the preheating phase, the greater will be the accuracy with which the temperature gradient can be controlled and adapted to an ideal curve. In practice, quite useful results are achieved when the preheating phase is subdivided into three to six intervals, and when accordingly three to six threshold values are determined for the upper limit of the gradient. The lower limit for the gradient, where the effective supply voltage may be temporarily increased so as to accelerate the heating-up process of the glow plug, can be determined correspondingly.

There are different ways of selecting the width of the steps within which the threshold values are kept constant. The steps may be determined on a time basis, but may also be related to the variation of the electric resistance or to the variation of the electric power consumption or to the progress of energy supply, the last-mentioned possibility being especially preferred because when the preheating phase is subdivided into intervals of identical energy supply this automatically will lead to the result that the threshold values will be adapted at shorter intervals as the temperature rise gets steeper.

Preferably, the gradients are measured periodically and in a recurrent way. The shorter the period, the more perfect the control. Conveniently, the gradient is determined at least 20 times per second, preferably at least 30 times per second. The frequency of pulse width modulation, used for adjusting the effective supply voltage, preferably is equal to one integral multiple of the frequency of determination of the gradient; a method where the two frequencies conform one with the other is especially preferred. This allows the points in time where the gradients are determined to be synchronized with the pulse width modulation for the power supply.

One advantage of the invention resides in the fact that it is now even possible to control the curve of the electric resistance or of the electric power consumption to a nominal value that can be derived from the ideal temperature curve of an ideal glow plug. This allows the real temperature curve of the real glow plug to be optimally approximated to the ideal. The ideal temperature curve of an ideal glow plug can be stored in the control device for the glow plug, for example in a memory of the microprocessor or the microcontroller that controls the voltage supply of the glow plug and the process of determining the measured values for determination of the gradients, that compares the gradients with the threshold values and that adjusts the respective voltage supplied to the glow plug as a function of the result of such comparison. The threshold values may be stored in the memory of the microprocessor or microcontroller especially as a sequence of discrete threshold values, distributed troller especially as a sequence of discrete threshold values, distributed over the curve of the preheating phase, from which the microprocessor or the microcontroller selects at any time the one that belongs to the respective point in time in the respective preheating phase for which the gradient had been determined.

Figure 2:
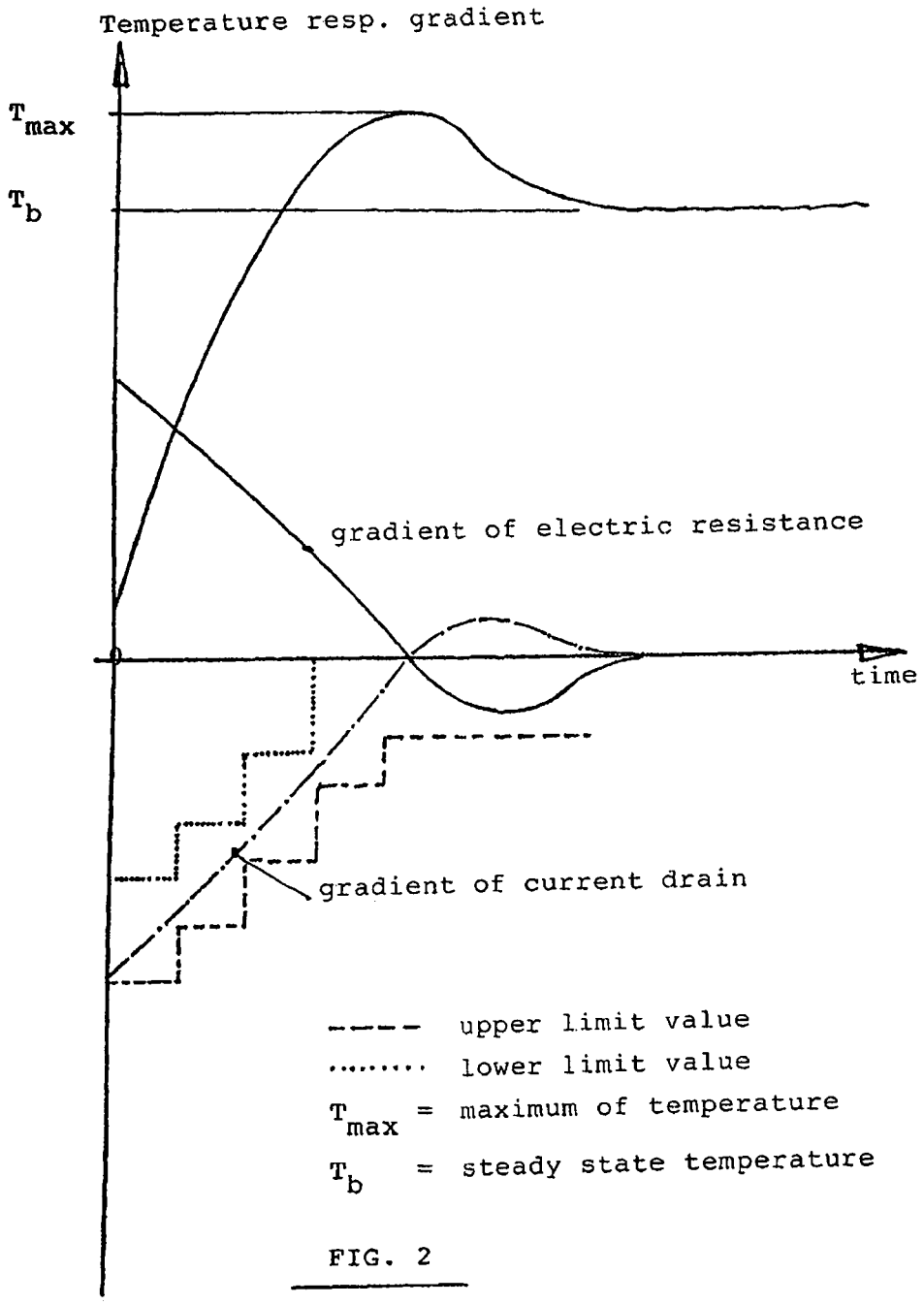
FIG. 2 shows a typical curve of the temperature of a glow plug and the related curves of the gradients of the glow plug resistance and of the current flowing through the glow plug, as well as certain examples for the selection of threshold values.

The attached FIG. 2 shows by way of example a typical curve of the temperature of a glow plug and the related curves of the gradients of the glow plug resistance and of the current flowing through the glow plug, as well as certain examples for the selection of threshold values.

What is claimed is:

1. A method for controlling a glow plug in a diesel engine during a preheating phase, the method comprising:

during a preheating phase a time gradient of an electric resistance of the glow plug, which varies as a function of temperature of the glow plug, is measured and compared with a pre-defined upper threshold value and a pre-defined lower threshold value, and an effective electric supply voltage of the glow plug is a pulse width modulated voltage, where the effective electric supply voltage is varied when the time gradient exceeds the upper threshold value or drops below the lower threshold values, where the upper threshold value and the lower threshold value are different from one another, and where at least one of these two threshold values is changed during the preheating phase.

2. The method as defined in claim 1, wherein the effective electric supply voltage of the glow plug is reduced when the absolute value of the gradient exceeds the upper threshold value.

3. The method as defined in claim 1, wherein the effective electric supply voltage of the glow plug is increased when the absolute value of the gradient drops below the lower threshold value.

4. The method as defined in claim 1, wherein the lower threshold value and the upper threshold value are varied as a function of the electric resistance measured.

5. The method as defined in claim 1, wherein the lower threshold value and the upper threshold value are varied as a function of time.

6. The method as defined in claim 1, wherein lower threshold value and the upper threshold value are varied as a function of an electric energy precedingly supplied to the glow plug.

7. The method as defined in claim 1, wherein the lower threshold value and the upper threshold value are varied in steps during the preheating phase.

8. The method as defined in a claim 1, wherein the time gradient is determined at least in the steepest section of a heating-up curve of the glow plug.

9. The method as defined in claim 1, wherein the time gradient is determined repeatedly during the preheating phase.

10. The method as defined in claim 9, wherein the time gradient is determined periodically.

11. The method as defined in claim 10, wherein the time gradient is determined at least 20 times per second.

12. The method as defined in claim 9, wherein the effective supply voltage to the glow plug is obtained by pulse width modulation from the voltage of an on-board system and that the points in time at which the measurements are taken to determine the time gradient lie within time windows during which the effective supply voltage is supplied to the glow plug.

13. The method as defined in claim 12, wherein the points in time at which the measurements are taken to determine the time gradient are synchronized with the period of pulse width modulation.

14. The method as defined in claim 1, wherein the time gradient is controlled to comply with a nominal value.

15. The method as defined in claim 14, wherein the nominal value is derived from a nominal characteristic of the time gradient.

16. The method as defined in claim 15, wherein the nominal characteristic is stored in a control unit for the glow plug.

17. The method as defined in claim 1, wherein an electric energy supplied to the glow plug in the preheating phase is determined in advance.

18. A method for controlling a glow plug in a diesel engine during a preheating phase, the method comprising:

during a preheating phase a time gradient of an electric current of the glow plug, which varies as a function of temperature of the glow plug, is measured and compared with a pre-defined upper threshold value and a pre-defined lower threshold value, and an effective electric supply voltage of the glow plug comprises a pulse width modulated voltage and varied when the time gradient exceeds the upper threshold value or drops below the lower threshold value, where the upper threshold values and the lower threshold value are different from one another during the preheating phase and at least one of them is changed during the preheating phase.

19. The method of claim 18, wherein the lower threshold value and the upper threshold values are varied during the preheating phase as a function of the current measured.

* * * * *

UNITED STATES PATENT AND TRADEMARK OFFICE

CERTIFICATE OF CORRECTION

PATENT NO. : 8,976,505 B2
APPLICATION NO. : 12/227736
DATED : March 10, 2015
INVENTOR(S) : Markus Kernwein and Olaf Toedter It is certified that error appears in the above-identified patent and that said Letters Patent is hereby corrected as shown below:

In the Claims,

Column 8, line 36, Claim 18 “values” should read --value--.

Column 8, line 41, Claim 19 “values” should read --value--.

Signed and Sealed this
Ninth Day of June, 2015

Michelle K. Lee

Michelle K. Lee
*Director of the United States Patent and Trademark Office*